US006943307B2

(12) United States Patent
Hunger et al.

(10) Patent No.: US 6,943,307 B2
(45) Date of Patent: Sep. 13, 2005

(54) SWITCHING DEVICE

(75) Inventors: Olaf Hunger, Schaffhausen (CH); Kurt Dahinden, Rapperswil (CH); Thomas Schoenemann, Schafisheim (CH)

(73) Assignee: Alstom Technology, Ltd., Baden (CH)

( * ) Notice: Subject to any disclaimer, the term of this patent is extended or adjusted under 35 U.S.C. 154(b) by 0 days.

(21) Appl. No.: 10/485,866

(22) PCT Filed: Aug. 13, 2002

(86) PCT No.: PCT/CH02/00443

§ 371 (c)(1),
(2), (4) Date: Feb. 5, 2004

(87) PCT Pub. No.: WO03/017305

PCT Pub. Date: Feb. 27, 2003

(65) Prior Publication Data

US 2004/0216990 A1 Nov. 4, 2004

(30) Foreign Application Priority Data

Aug. 15, 2001 (EP) ..... 01810788

(51) Int. Cl.[7] ..... H01H 33/14
(52) U.S. Cl. ..... 200/48 R; 218/7; 218/153
(58) Field of Search ..... 200/17 R, 48 R–48 CB, 200/50.32, 337, 500, 501; 218/2–7, 78, 84, 120, 140, 152–154

(56) References Cited

U.S. PATENT DOCUMENTS 2,878,331 A * 3/1959 Fjellstedt ..... 200/48 R
2,978,558 A * 4/1961 Barta ..... 218/14
3,165,601 A * 1/1965 Bohler ..... 200/48 R
3,787,649 A 1/1974 Goodwin, Jr. et al.
4,814,560 A 3/1989 Akesson
5,128,502 A * 7/1992 Hux ..... 218/153
5,821,486 A 10/1998 Paw et al.
5,936,213 A * 8/1999 Biquez et al. ..... 200/1 V
6,313,424 B1 * 11/2001 Bachofen ..... 218/6

FOREIGN PATENT DOCUMENTS

DE 195 24 636 C1 9/1996
DE 197 35 924 A1 2/1999

* cited by examiner

*Primary Examiner*—Michael A. Friedhofer
(74) *Attorney, Agent, or Firm*—Burns, Doane, Swecker & Mathis, P.C.

(57) ABSTRACT

The switching device for switching high electrical currents and voltages has at least one switch pole (1, 1', 1") which is operated by means of a rotatable shaft (8, 8', 8"). Furthermore, the switching device has at least one lever system (10, 10', 10"), a first switching linkage (11) and at least one drive (2) with a drive rod (24), with the rotatable shaft (8, 8', 8") being connected to the lever system (10, 10', 10"), the lever system (10, 10', 10") being connected to the first switching linkage (11), and the first switching linkage (11) being operatively connected to the drive rod (24). Movements of the drive rod (24) are converted to rotary movements of the rotatable shaft (8, 8', 8"). The physical space which is required for installation of the switching device is intended to be capable of being matched to the physical circumstances. This is achieved in that a transmission (15) which is connected to the first switching linkage (11) and a second switching linkage (21) which is connected to the transmission (15) and to the drive rod (24) are provided. This arrangement makes it possible to arrange the drive (2) such that physical circumstances, for example existing concrete edges, can remain, and the physical space which is required by the switching device can be minimized.

16 Claims, 4 Drawing Sheets

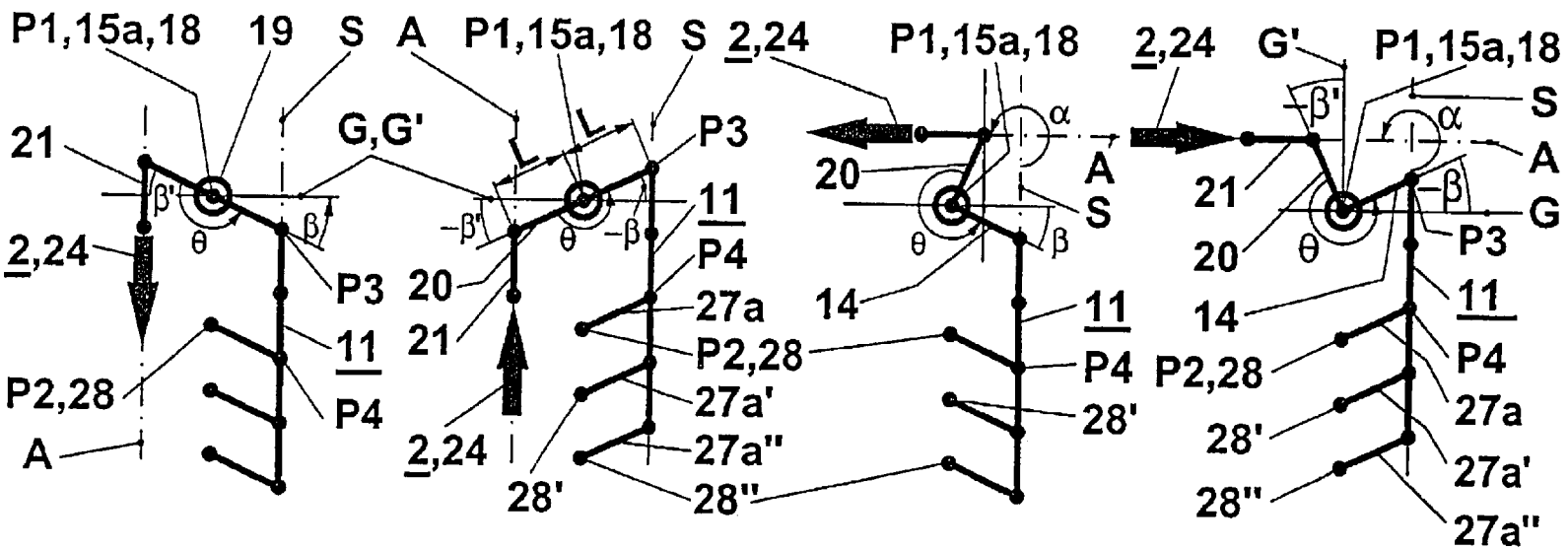
FIG. 3a
FIG. 3c
FIG. 4a
FIG. 4c
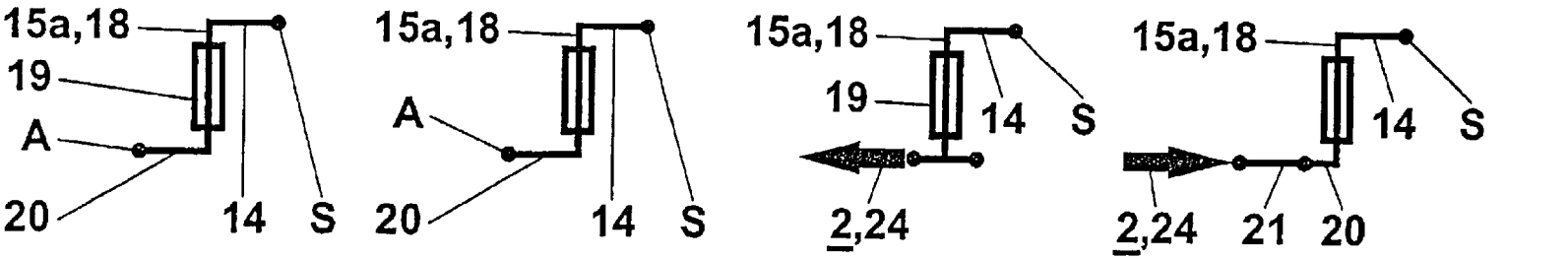
FIG. 3b
FIG. 3d
FIG. 4b
FIG. 4d

SWITCHING DEVICE

TECHNICAL FIELD

The invention relates to the field of high-power switch technology, in particular to a switching device for switching high electrical currents and voltages as claimed in the precharacterizing clause of patent claim 1.

PRIOR ART

By way of example, a switching device such as this is a generator switch which has one identical switch pole for each of three phases. A switch pole such as this is in the form of a metal-encapsulated switch and has a quenching chamber which is filled with insulating gas, in which rated current and power current contacts for the associated phase are located. A switch pole such as this also has a rotatable shaft and is used to transmit a force from ground potential to a high-voltage potential in the quenching chamber. A force such as this is used to connect or disconnect the rated current contacts and power current contacts, in order to switch the respective phase on or off.

The switch poles each have a base flange, which is at ground potential and is mounted on a pole frame table of a pole frame of the generator switch. The rotatable shafts project to such an extent from the base flanges that they can be driven underneath the pole frame table, that is to say on that side of the pole frame table which faces away from the switch poles. Each of the rotatable shafts is connected by means of two levers and a holder, underneath the pole frame table, to a switching linkage, which is likewise located underneath the pole frame table.

This switching linkage has a lug, and a rod which is composed of two or more rod elements. At one of its ends, the switching linkage is connected by means of the lug to a drive rod for a hydraulic spring storage drive, such that any translational movement of the drive rod is converted by the switching linkage and the two levers and the holder to rotation of the rotatable shaft. The drive is arranged at the side, alongside the pole frame, with the drive rod being located at least approximately on an imaginary axial extension of the switching linkage, thus allowing any movement of the drive rod to be transmitted as directly as possible to the switching linkage.

Because the drive is located outside the pole frame, the space requirement for a generator switch such as this is comparatively large. Since the switch poles are mounted in a row alongside one another on the pole frame table and, furthermore, the drive is also arranged essentially in an extension of this row, the space which is occupied by a generator switch such as this is very large, particularly in this direction. Physical circumstances thus often make it impossible to install a switching device such as this, in particular when it is necessary to install a switching device retrospectively in a given space.

DESCRIPTION OF THE INVENTION

The object of the invention is therefore to provide a switching device of the type mentioned initially which does not have the disadvantages mentioned above. A particular aim is to reduce the amount of physical space occupied by the switching device. A further aim is for the physical space which is occupied by the switching device to be capable of being matched flexibly to physical circumstances. A further aim is to allow retrospective installation of a switching device such as this in confined physical boundary conditions. A further aim is to allow the switching device to be designed to be more robust from the point of view of seismic loading as well.

This object is achieved by a switching device having the features of patent claim 1.

A transmission and a second switching linkage are provided in the switching device according to the invention. This second switching linkage connects a drive rod of a drive to the transmission, and the transmission is connected to a first switching linkage in the switching device. It is thus possible to arrange the drive at a location which can be chosen in that area, and to reduce the space requirement of the switching device.

In particular, the switching device may be designed such that an angle $\alpha$ between the longitudinal axis of the first switching linkage and a projection of the longitudinal axis of the drive rod onto a first plane can be chosen, wherein the first plane is defined such that it is at right angles to a rotatable shaft of a switch pole, and contains the longitudinal axis of the first switching linkage. This means that it is possible to match the switching device flexibly to the physical circumstances, particularly when the switching device is intended to be installed retrospectively in an existing installation.

Furthermore, the drive can be arranged such that the longitudinal axis of the drive rod lies on a second plane, which is parallel to said first plane and is not the same as this first plane. This makes it possible to flexibly match the switching device to the physical circumstances.

It is advantageous for the drive to be arranged such that it lies on said second plane and such that the angle $\alpha$ is chosen to be 0°. This makes it possible to reduce the space that is required by the switching device.

It is likewise advantageous to arrange the drive such that the angle $\alpha$ is chosen to be 90° or 270°. This allows the physical space which is required for the switching device to be reduced, in particular along the direction which is defined by the longitudinal axis of the first switching linkage. It may also be advantageous to choose the angle $\alpha$ to be 180°, in order to match the switching device to physical circumstances.

In one preferred embodiment, the transmission has a first rocker lever and a second rocker lever and a shaft, which connects the rocker levers to one another, wherein the first switching linkage is connected to the shaft by means of the first rocker lever, and the second switching linkage is connected to the shaft by means of the second rocker lever, and wherein the shaft is mounted such that it can rotate. This embodiment can be produced at very low cost, and an appropriate configuration of the shaft makes it possible to select the distance between the first plane and the second plane. This embodiment is particularly advantageous when a rotation axis of the shaft is aligned essentially parallel to the longitudinal axis of the rotatable shaft, and the two rocker levers are aligned at right angles to this rotation axis. In this case, an arrangement of the drive in which the longitudinal axis of the drive rod lies on said first plane or on said second plane is particularly robust, and can be produced easily.

In a further advantageous embodiment, the shaft has at least one external tooth system, and at least one of the rocker levers has an internal tooth system which matches the external tooth system. This means that the capability to select the angle $\alpha$ can be achieved robustly and advantageously.

One extraordinarily advantageous embodiment of the subject matter of the invention is characterized in that the intersection of the rotation axis of the shaft with the first plane, the intersection of a bolt with the first plane, the projection of the connection between the first rocker lever and the first switching linkage onto the first plane, and the projection of the connection between a lever system and the first switching linkage onto the first plane at least approximately form a parallelogram, wherein the lever system connects the rotatable shaft to the first switching linkage and has an angled lever, and wherein the bolt is rigidly connected to a base flange of the switch pole and is connected to a limb of the angled lever such that it can rotate. In particular, it is also advantageous for the lever lengths of the first rocker lever and of the second rocker lever to be of equal size. This means that forces and lever geometries as are used in a switching device which is regarded as the prior art can largely be retained, thus making it possible to use identical parts. This allows a switch according to the invention to be produced at extremely low cost.

It is also advantageous if, subject to the precondition that the switching device has a pole frame with a pole frame table, the drive is arranged essentially on that side of the pole frame table, which is facing away from the at least one switch pole. Particularly, if the pole frame table is arranged essentially perpendicular to the rotatable shaft. This allows the drive to be arranged within the pole frame, and the physical space required by the switching device to be minimized.

In one particularly preferred embodiment, the angle $\alpha$ is chosen to be 0°, and the drive is arranged essentially on that side of the pole frame table, which is facing away from the at least one switch pole. This makes it possible to produce a switching device which is particularly compact and is optimized with respect to seismic factors.

A major advantage is obtained if, when there are three switch poles which each have a lever system, the transmission and the lever systems are connected to the first switching linkage in the sequence transmission, lever system, lever system, lever system. In this way, any movement of the first switching linkage produces either a pushing force or a pulling force on all of these lever systems. During a switching process, the same force then advantageously acts in the same way on all of the rotatable rods of the switch poles, with high accuracy and at the same time. It is thus possible to use identical parts for the switching device according to the invention, thus making the production of the switching device considerably more cost-effective.

Further preferred embodiments are described in the dependent patent claims.

BRIEF DESCRIPTION OF THE DRAWINGS

The subject matter of the invention will be explained in more detail in the following text with reference to preferred exemplary embodiments which are illustrated in the attached drawings, in which:

FIGS. 3*a–d* show the schematic illustration of arrangements according to the invention of switch poles, transmissions and drives where the angle $\alpha$ is 0°. The switched-on state in the plan view (a) and in the side view (b); the switched-off state in the plan view (c) and in the aide view (d);

FIGS. 4*a–d* show the schematic illustration of arrangements according to the invention of switch poles, transmissions and drives where the angle $\alpha$ is 270°. The switched-on state in the plan view (a) and in the side view (b); the switched-off state in the plan view (c) and in the side view (d);

The reference symbols used in the drawings, and their meanings, are listed in summarized form in the list of reference symbols. In principle, identical parts are provided with the same reference symbols in the figures.

Approaches to Implementation of the Invention

Figure 1:
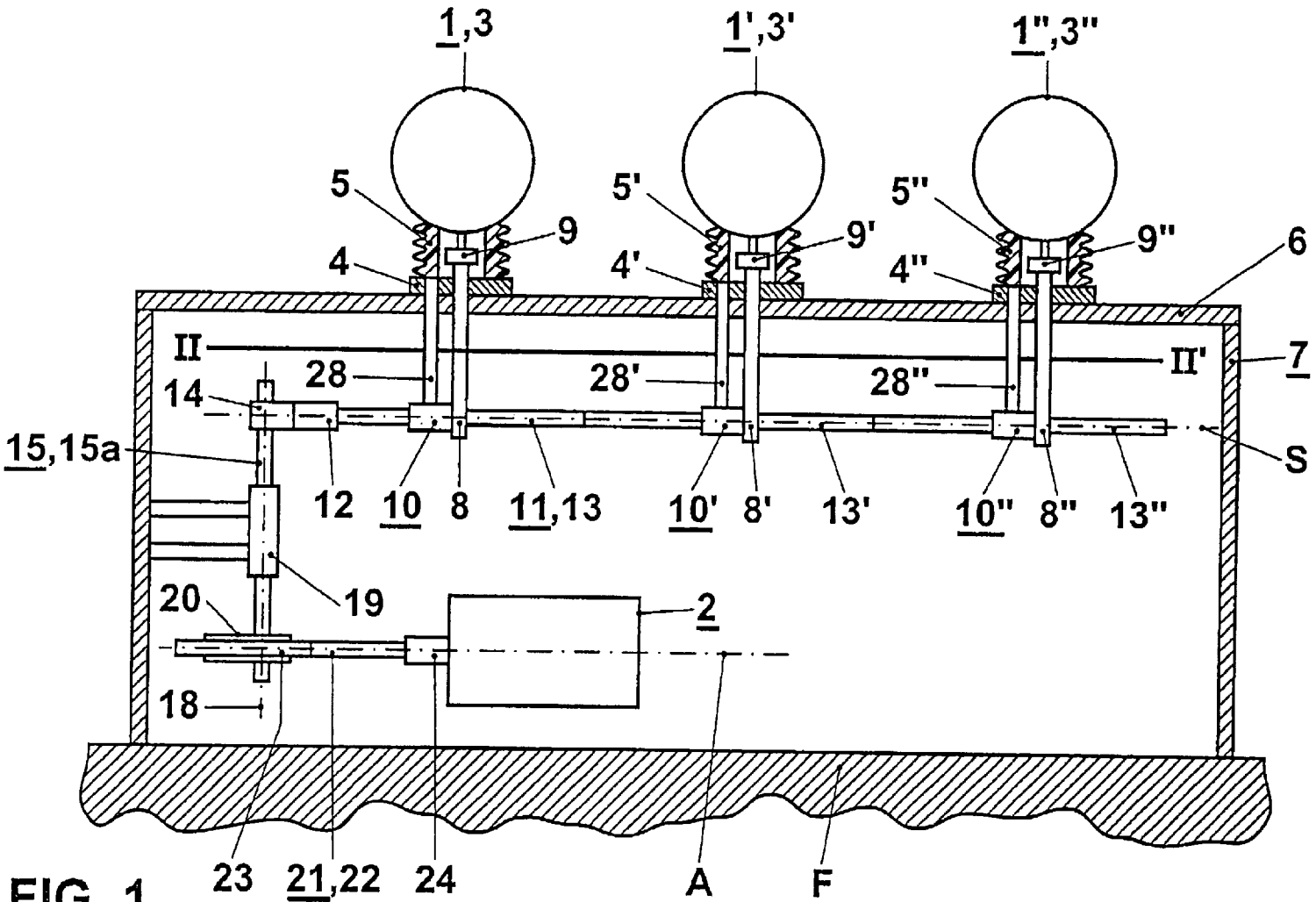
FIG. 1 shows a side view of a switching device according to the invention, having three switch poles, in the switched-on state, illustrated schematically and partially cut away.

FIG. 1 shows schematically and in the form of a side view, partially in section, a switching device according to the invention in the switched-on state. The switching device is in the form of a generator switch and has three symbolically illustrated switch poles 1, 1', 1" and a drive 2. Each of the switch poles has an active part 3, 3', 3", which, during normal operation, is at a high-voltage potential, a base flange 4, 4', 4" which is at ground potential, and an isolator 5, 5', 5" which connects the active part 3, 3', 3" to the base flange 4, 4', 4". The base flanges 4, 4', 4" are rigidly connected to a respective bolt 28, 28', 28" and are mounted on a pole frame table 6 of a pole frame 7 in a row alongside one another, with the pole frame 7 being connected to a foundation F. Each of the switch poles 1, 1', 1" has a rotatable shaft 8, 8', 8", which is used to transmit a force from the drive 2, which is at ground potential, to the active part 3, 3', 3" which is at high-voltage potential. An isolating intermediate piece 9, 9', 9" is respectively connected to each of the rotatable shafts 8, 8', 8", and bridges the potential difference.

Each of the rotatable shafts 8, 8', 8" and each of the bolts 28, 28', 28" which [sic] projects out of the associated base flange 4, 4', 41' to underneath the pole frame table 6, that is to say as far as that side of the pole frame table 6 which faces away from the switch poles 1, 1', 1". There, they are connected to a respective lever system 10, 10', 10", which is connected, such that it can move, to a first switching linkage 11 which is likewise arranged underneath the pole frame table 6. This first switching linkage 11 has a first lug 12, which can move in both directions, and two or more rod elements 13, 13', 13" which are connected to one another such that force can be transmitted and are arranged one behind the other. These rod elements 13, 13', 13" form an essentially straight section of the first switching linkage 11, along which the first switching linkage 11 essentially extends. A longitudinal axis S of the first switching linkage 11 is defined around this, as the longitudinal axis of these rod elements 13, 13', 13". The longitudinal axis S of the first switching linkage 11 lies on a first plane, which is at right angles to the rotatable shafts 8, 8', 8". Since the three switch poles 1, 1', 1" and the three lever systems 10, 10', 10" are essentially identical, the longitudinal axis S of the first switching linkage 11 runs parallel to the intersections of the rotatable shafts 8, 8', 8" with said first plane.

The first switching linkage 11 is connected close to one of its ends and by means of the first lug 12 to a first rocker lever 14 such that it can rotate, and this first rocker lever 11 has a lever arm with a lever length L. This first rocker lever 14 is a component of a transmission 15 which in this case is in the form of a step-up lever system which also has a shaft 15*a* and a second rocker lever 20. The first rocker lever 14 is arranged essentially parallel to the first plane and has a detachable interlocking connection to the shaft 15*a*. This connection is provided by an internal tooth system 16 on the first rocker lever 14 and by an external tooth system 17, which matches it, on the shaft 15*a*, as is illustrated in FIG. 1. A rotation axis 18 of the shaft 15*a* is aligned essentially parallel to the rotatable shafts 8, 8', 8" The shaft 15*a* is mounted such that it can rotate about its rotation axis 18 by means of a bearing 19 which is attached to the pole frame 7 and is arranged on the side of the first rocker lever 14 facing away from the pole frame table 6. The lever arm of the first rocker lever 14, projected onto the first plane, includes an angle β with a straight line G which is at right angles to the longitudinal axis S of the first switching linkage 11 and runs through the rotation axis 18, with this angle β typically being between about 25° and about 40°, and preferably about β≈35°.

On the side of the bearing 19 facing away from the first rocker lever 14, the shaft 15*a* likewise has an external tooth system, which represents a detachable interlocking connection between the shaft 15*a* and the second rocker lever 20, which is physically similar to the first rocker lever 14. This second rocker lever 20 has a matching internal tooth system and has a lever length L', which in this case is equal to the lever length L of the first rocker lever 14 The second rocker lever 20 is arranged essentially parallel to the first plane, to be precise such that its lever arm projected onto the first plane includes an angle θ with a lever arm, projected onto the first plane, of the first rocker lever 14, and in this case θ=180°.

The second rocker lever 20 is connected to a second switching linkage 21, which has a rod 22 and a second lug 23 which moves in both directions. This second lug 23 connects the second rocker lever 20 to the rod 22 of the second switching linkage 21, which is connected to a drive rod 24 of the drive 2 such that force can be transmitted. The rod 22 of the second switching linkage 1 and the drive rod 24 of the drive 2 as well as the second lug 23 are arranged one behind the other essentially along a common longitudinal axis. The alignment of this common longitudinal axis is chosen such that a lever arm, projected onto the first plane, of the second rocker lever 20 includes an angle β' with a projection onto the first plane of a straight line G', which is at right angles to the longitudinal axis A of the drive rod 24 and runs through the rotation axis 18, with this angle β' in this case being of equal magnitude to the angle β. Since the angle θ is chosen to be 180° and β'32 β, this common longitudinal axis and thus the longitudinal axis A of the drive rod 24 in this case run parallel to the longitudinal axis S of the first switching linkage 11. An angle α, which is not illustrated in FIG. 1, between the longitudinal axis S of the first switching linkage 11 and the projection onto the first plane of the longitudinal axis A of the drive rod 24 is in this case α=180°. In this case, a convention is chosen in which the angle α would be 0° in the event of colinear movement of the drive rod 24 and of the longitudinal axis S of the first switching linkage 11.

The drive 2, which is in the form of a hydraulic spring storage drive, is arranged underneath the pole frame table 6, and is connected to the pole frame 7 by means of an attachment which is not illustrated.

Figure 2:
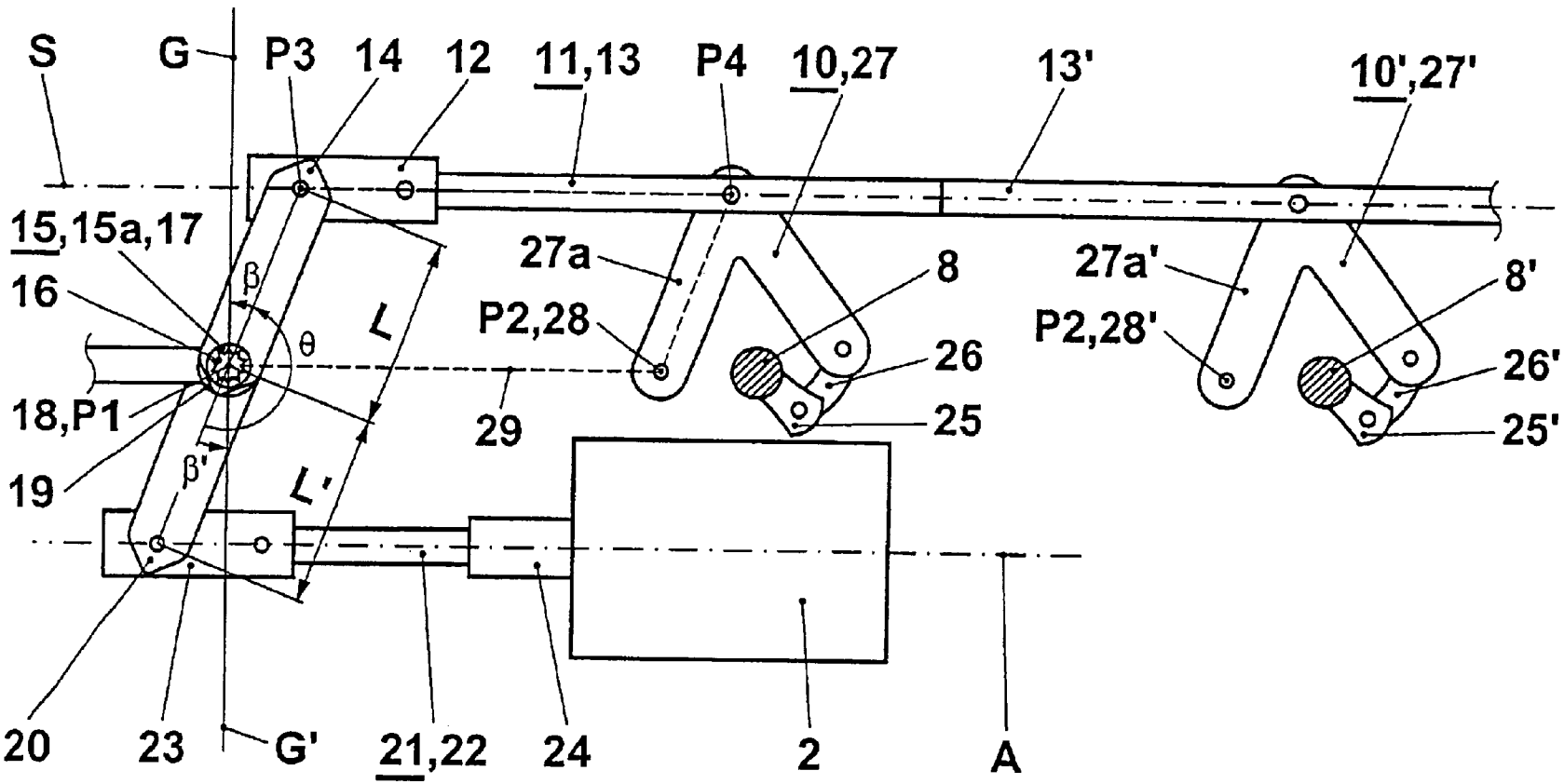
FIG. 2 shows a plan view along the section II–II' through the switching device according to the invention as shown in FIG. 1, illustrated schematically.
Figure 5C:
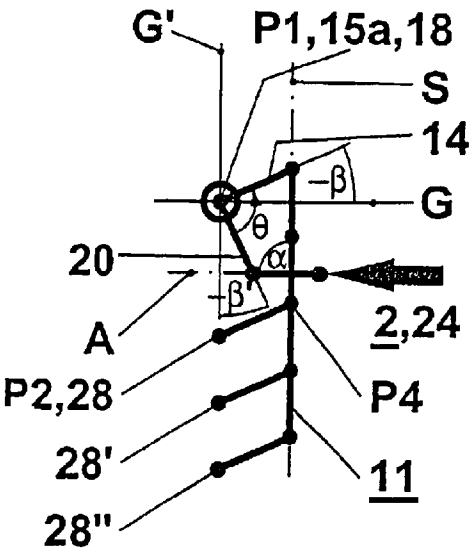
FIGS. 5*a–d* show the schematic illustration of arrangements according to the invention of switch poles, transmissions and drives where the angle $\alpha$ is 90°. The switched-on state in the plan view (a) and in the side view (b); the switched-off state in the plan view (c) and in the side view (d).
Figure 5D:
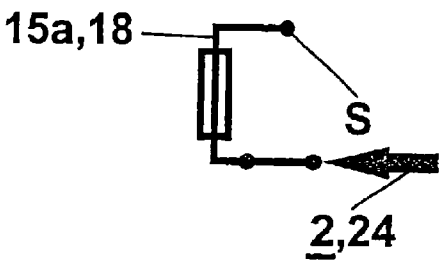
Figure 5A:
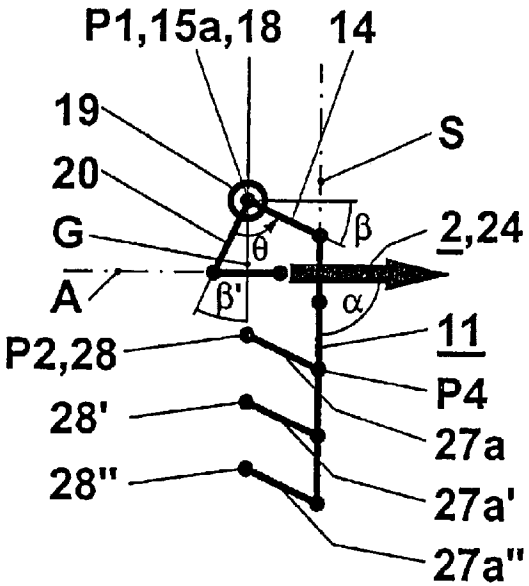
Figure 5B:
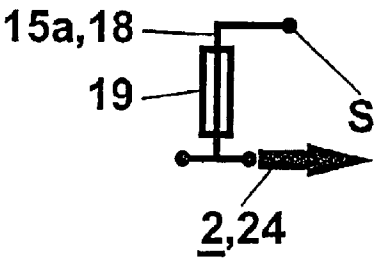

FIG. 2 shows, schematically, a plan view along a section II–II' of the switching device according to the invention as shown in FIG. 1. Said lever systems 10, 10', 10" are illustrated in more detail in this figure. These respectively comprise a holder 25, 25', 25", which is rigidly connected to the associated rotatable shaft 8, 8', 8", as well as a respective curved lever 26, 26', 26" and a respective angled lever 27, 27', 27". The holder 25, 25', 25" is connected to the curved lever 26, 26', 26" such that it can rotate. At a second end, the curved lever 26, 26', 26" is connected to a first limb of the angled lever 27, 27', 27" such that it can rotate. The angled lever 27, 27', 27" is also connected to the rod element 13, 13', 13" of the first switching linkage 11 such that it can rotate, and is connected on a second limb 27*a* to the bolt 28, 28', 28" such that it can rotate. The bolts 28, 28', 28" are rigidly connected to the base flanges 4, 4', 4", and thus to the switch poles 1, 1', 1'.

The lever lengths L and L' of the first rocker lever 14 and of the second rocker lever 20, respectively, as well as the angle θ between the projections of the lever arms of the first rocker lever 14 and of the second rocker lever 20 onto the first plane, are shown in FIG. 2. Positions P1, P2, P3 and P4 are also shown, where

- P1 denotes the intersection of the rotation axis 18 of the shaft 15*a* with the first plane,
- P2 denotes the intersection of the bolt 28 of the switch pole 1 with the first plane,
- P3 denotes the projection of the connection between the first rocker lever 14 and the first switching linkage 11 onto the first plane, and
- P4 denotes the projection of the connection between the lever system 10 and the first switching linkage 11 onto the first plane.

The positions P1, P2, P3 and P4 form a parallelogram 29, and they are therefore located at the corner points of the parallelogram 29. The other switch poles 1', 1", bolts 28', 28" and lever systems 10', 10" have positions which correspond in the same sense to the positions P2 and P4, and which likewise each form a parallelogram with the positions P1 and P3, although this is not illustrated in FIG. 2.

FIGS. 1 and 2 will be considered in more detail in order to explain the method of operation. Any movement of the drive rod 24 of the drive 2 in the direction into the drive 2 in consequence results in the three switch poles 1, 1', 1", and hence the generator switch, being switched off: This movement of the drive rod 24 results in the rod 22 of the second switching linkage 21 moving colinearly with the drive rod 24. The movement is transmitted by means of the second lug 23 to the second rocker lever 20, which then carries out a rotary movement about the rotation axis 18 of the shaft 15*a*, thus producing a rotary movement of the shaft 15*a*. As a result of the rotary movement of the second rocker lever 20, the connection, which is originally arranged along the direction of movement of the drive rod 24, between the second rocker lever 20 and the second lug 23 moves on a circular path around the rotation axis 18 of the shaft 15*a*. This therefore results in lateral discrepancies in the position of the connection between the second rocker lever 20 and the second lug 23 from the direction of movement of the drive rod 24. These lateral discrepancies are made possible by the capability of the second lug 23 to move in both directions.

The rotation of the shaft 15*a* results in a rotary movement of the first rocker lever 14. This rotary movement is converted by means of the first lug 12 to a movement of the rod elements 13, 13', 13" of the first switching linkage 11. This movement is composed of a translational movement along the longitudinal axis S of the first switching linkage 11, and of a lateral movement of the first switching linkage 11 within the first plane. This lateral movement results from the fact that the rod elements 13, 13', 13" are connected to the angled levers 27, 27', 27", which are in turn connected, such that they can rotate, to the bolts 28, 28', 28", which are rigidly connected to the base flanges 4, 4', 4". The angled levers 27, 27', 27" and hence the positions of the connections between the angled levers 27, 27', 27" and the rod elements 13, 13', 13" thus move on circular paths around the bolts 28, 28', 28", which are rigidly connected to the base flanges 4, 4', 4".

The described lateral discrepancy is approximately of the same magnitude as the lateral discrepancy experienced by the connection between the first rocker lever 14 and the first switching linkage 11 as a result of the rotation of the shaft 15*a*. Any differences between these two lateral discrepancies are compensated for by the first lug 12, which can move in both directions, essentially in the same way as that which has been described further above in conjunction with the second lugs 23.

As described above, the movement of the rod elements 13, 13', 13" leads to a movement of the angled levers 27, 27', 27", which in turn results in a movement of the curved levers 26, 26', 26". The curved levers 26, 26', 26" then exert a force on the holders 25, 25', 25", leading to rotation of the rotatable shafts 8, 8', 8". The configuration of the lever systems 10, 10', 10" is chosen so as to achieve a speed/time profile, which is suitable for switching the switch poles 1, 1', 1", for the rotary movement of the rotatable shafts 8, 8', 8".

The rotary movement of the rotatable shafts 8, 8', 8" is used to transmit a force from ground potential to the active parts 3, 3', 3" which are at high-voltage potential. This force results in the rated current contacts and power current contacts of the switch poles 1, 1', 1" being connected, in order to switch on an associated phase.

The generator switch is switched on in an entirely analogous manner by the drive rod 24 of the drive 2 moving away from the drive 2. The angle β in the switched-on state is approximately 360° minus the angle β in the switched-off state, so that the angle β has a negative value in the switched-off state, and therefore β'=β as well.

The internal tooth system 16 on the first rocker lever 14 and the external tooth system 17 on the shaft 15*a* make it possible to choose the angle θ which is included by the lever arm, projected onto the first plane, of the second rocker lever 20 and the lever arm, projected onto the first plane, of the first rocker lever 14. Any desired angle θ can be produced by choice or alignment of the tooth system. It is therefore also possible to choose any desired angle α. This makes it possible to match the switching device and, in particular, the arrangement of the drive 2 to physical circumstances.

Appropriate configuration of the shaft 15*a* makes it possible to arrange the drive rod 24 and thus the drive 2 such that the longitudinal axis A of the drive rod 24 does not lie on the first plane. In particular, the drive 2 can be arranged such that the drive rod 24 lies on any desired second plane, which is parallel to the first plane but not is the same as the first plane. The longitudinal axis A of the drive rod 24 then lies on a plane which is essentially at right angles to the rotatable shafts 8, 8', 8", and does not contain a longitudinal axis of the essentially straight section of the first switching linkage. The shaft 15*a* may also be configured such that the longitudinal axis A lies on the first plane.

FIG. 3 shows, in a highly schematic manner, the generator switch according to the invention as illustrated in FIGS. 1 and 2. The elements of the generator switch are in this case illustrated symbolically. In FIG. 3*a*, the same plan view is chosen as that in FIG. 2, and the generator is likewise in the switched-on state. The bolts 28, 28', 28" are connected by means of the second limbs 27*a*, 27*a'*, 27*a"* of the angled levers 27, 27', 27" to the first switching linkage 11, which has the first lug 12 at one of its ends. The latter is connected to the first rocker lever 14, which is connected to the shaft 15*a*, which is mounted by means of the bearing 19 such that it can rotate about the rotation axis 18. The second rocker lever 20, which is connected to the shaft 15*a*, is connected to the second switching linkage 21, which is connected to the drive rod 24 of the drive 2. The drive rod 24 and the drive 2 are symbolized by an arrow in FIG. 3, indicating the direction of movement of the drive rod 24, along which the drive rod 24 moves in order to switch from the switched-on state, as illustrated, to the other state, the switched-off state. As a result of the arrangement of the drive 2, the physical space which is required for the generator switch along the direction of the longitudinal axis S of the first switching linkage 11 is considerably less than in the case of the generator switches which are known from the prior art.

The lever lengths L and L' are in this case chosen to be of equal magnitude. The positions P1, P2, P3, P4 form a parallelogram. The angle β' is chosen to have the same magnitude of approximately 25° as the angle β. The angle θ is equal to 180°, so that the angle α, which is not illustrated, is also 180°.

FIG. 3*b* shows a side view of the configuration, as illustrated in FIG. 3*a*, along the longitudinal axis S of the first switching linkage 11. The longitudinal axis S of the first switching linkage 11 and the longitudinal axis A of the drive rod 24 lie on two different planes, which are at right angles to the rotation axis 18, with the rotation axis 18 running parallel to the rotatable shafts 8, 8', 8". The longitudinal axis S lies on the first plane, and the longitudinal axis A lies on the second plane.

In an analogous manner to FIG. 3*a*, FIG. 3*c* shows the generator switch in the switched-off state. The angles β and β' in the switched-off state have precisely the same negative values as in the switched-on state. The values of the angles θ and α do not change.

In an analogous manner to FIG. 3*b*, FIG. 3*d* shows a side view of the generator switch in the switched-off state from FIG. 3*c*.

In an analogous manner to the FIG. 3, FIGS. 4 and 5 show further generator switches, whose configuration is different to that illustrated in FIG. 3.

In FIG. 4, the angle θ is chosen to be 270°. This means that the angle α is 270°. Apart from this, the generator switch illustrated here corresponds to that shown in FIG. 3.

In FIG. 5, the angle θ is chosen to be 90°. This means that the angle α is 90°. Apart from this, the generator switch illustrated here corresponds to that shown in FIG. 3.

As an alternative to the switching devices which have been described and are illustrated in FIGS. 1 to 5, further embodiments according to the invention are also possible. Instead of being in the form of a generator switch, the switching device may, for example, also be in the form of a high-voltage circuit breaker, a medium-voltage circuit breaker, or a single-pole or two-pole switch. This switch pole 1, 1', 1" may operate on any desired switching principle, for example in the form of a gas-insulated switch, a compressed-air switch, an oil switch or a vacuum switch.

The drive 2 may also, for example, be a compressed-air drive or an electrical drive, or else a rotating drive, which does not transmit a force by a translational movement, but by a rotary movement of the drive rod 24.

Instead of a single drive 2 for a number of switch poles 1, 1', 1", it would also be possible, for example, to use a single drive for each switch pole 1, 1', 1".

The pole frame 7 is generally in the form of a table and is connected to a building floor, a building ceiling or to a wall as the foundation F. The pole frame table 6 may be in the form of a plate, or else may be stepped. The pole frame table 6 is preferably arranged essentially at right angles to the rotatable shafts 8, 8', 8". The various switch poles 1, 1', 1" may also be attached individually.

According to the invention, the drive 2 may be arranged underneath the pole frame table 6; although it may also be arranged at the side or, especially if the foundation F is a building ceiling, also above the pole frame table 6.

The lever systems 10, 10', 10" may also have more levers or components than stated in the above example. It is likewise possible for the lever systems 10, 10', 10" to be formed by fewer components, for example by in each case only one lever for each lever system 10, 10', 10".

As described, the bolts 28, 28', 28" may be rigidly connected to the base flanges 4, 4', 4" of the switch poles 1, 1', 1". Alternatively, they may also be rigidly connected to the pole frame 7. It is also feasible for the connection of the bolts 28, 28', 28" to one of said points to be designed such that it can rotate rather than being rigid, and for the connections between the bolts 28, 28', 28" and the second limbs 27*a*, 27*a'*, 27*a"* of the angled levers 27, 27', 27" to be designed to be rigid for this purpose.

The first switching linkage 11 may also be formed from a single rod element 13 or from a rod element 13 and a first lug 12. The rod elements 13, 13', 13" may also be entirely or partially curved. However, in general, there is an essentially straight section which defines the longitudinal axis S of the first switching linkage 11. This runs essentially parallel to a straight line which connects the rotatable shafts 8, 8', 8" of the switch poles 1, 1', 1", and is at right angles to the rotatable shafts 8, 8', 8".

The transmission 15 may also have a different lever step-up ratio to that described above. It may also be configured as a transmission of a different type. By way of example, if a rotating drive 2 is used, the transmission 15 could be formed from a shaft 15*a* and from only one first rocker lever 14, without the second rocker lever 20. Furthermore, however, more complex arrangements are also possible, including, for example, an angle step-up ratio. The latter may be used to match a drive 2 to an existing switching device, if the drive 2 has a different linear travel of the drive rod 24 than that originally envisaged for the switching device.

The shaft 15*a* makes it possible to choose the distance between the first plane and the second plane, which is parallel to the first plane, and on which the longitudinal axis A of the drive rod 24 lies. In particular, the shaft 15*a* may also be designed such that the longitudinal axis A lies on the first plane. The capability to choose the angle θ and the angle α may be provided not only by means of the tooth systems 16, 17 on the first rocker lever 14 with the shaft 15*a* and/or by means of the tooth systems on the second rocker lever 20 with the shaft 15*a*, and it is also possible to have an internal tooth system on the shaft 15*a*, and an external tooth system on one of the rocker levers 14, 20. Furthermore, bolt connections, screw connections and further force-fitting, interlocking or integral material connections are also possible. It is also possible to use two or more bearings instead of just one bearing 19 for the bearing for the shaft 15*a*.

The second switching linkage 21 may also be curved or may be composed of two or more rods 22, or else may be formed from only the second lug 23.

The numerous described connections which can rotate between the elements of the switching device may, for example, be in the form of bolt connections.

The lever lengths L and L' may also be chosen to have different magnitudes, if the operational requirements necessitate this. For example, if the aim is to fit in a switching device with a drive 2 whose drive rod 24 has a different linear travel or has a different force during the switching process than was originally envisaged for the switching device.

It is advantageous for the angle β and the angle β' in the switched-off state to have precisely the same but negative values as in the switched-on state. The positions of the first rocker lever 14 and of the second rocker lever 20 in the switched-on state and in the switched-off state are then arranged symmetrically with respect to the straight line G or the straight line G', respectively. If the operational requirements make this necessary, other arrangements may, however, also be provided, in which the angles β and β' do not need to have this symmetry.

The angles β and β' need not be chosen to be of equal magnitude. Angles β and β' of different magnitudes are feasible. It is likewise also possible to design a configuration such that the angles α and θ have different magnitudes. This means, for example, that it is very simple to match the speed/time profile that is provided in the switching device to changes in the operational requirements.

The angle β need not, as illustrated in the figures, be chosen to be sufficiently large that the lever arm of the first rocker lever 14 lies parallel to a straight line which runs through the positions P2 and P4. If operational requirements make this necessary, other angles β may also be chosen. However, in this case, the points P1, P2, P3 and P4 do not form a parallelogram. Furthermore, the lever length L of the first rocker lever 14 need not be of the same size as the distance between the position P2 and the position P4. In this case as well, the positions P1, P2, P3 and P4 do not form a parallelogram. The positions P1, P2, P3 and P4 advantageously form a parallelogram, although the important factor in this case is that the positions P3 and P4 represent two points on the longitudinal axis S of the essentially straight part of the first switching linkage.

In the described examples, the connection between the transmission 15 and the first switching linkage 11 is arranged approximately at one end of the first switching linkage 11. This has the advantage that, during a switching process, the same force acts on all the rotatable rods 8, 8', 8" of the switch poles 1, 1', 1" in the same way, with great accuracy and at the same time. If, as in the described examples, a pushing force acts on the first switching linkage 11 when the switching device is being switched on, then the same pushing force acts on each of the angled levers 27, 27', 27" and is then converted by the lever systems 10, 10', 10" to a pushing force of equal magnitude for all three switch poles 1, 1', 1", and this then acts on the respective rotatable rod 8, 8', 8". The switching-off process takes place in an analogous manner. However, it is also possible to arrange the connection between the transmission 15 and the first switching linkage 11 such that it lies between two of the three switch poles 1, 1', 1". In this situation, two of the three switch poles 1, 1', 1" would experience a pulling force on their associated angled lever during a switching-on process, while, in contrast, one of the switch poles would experience a pulling force on the angled lever associated with it. These pulling and pushing forces, respectively, may also act with slight time delays.

Furthermore, generally, the forces to be applied by the drive 2 for switching are greater during a switching-off process than during a switching-on process. This must be taken into account in a switching device configuration according to the invention. In the examples which have been described from the figures, this has already been taken into account in that a movement of the switching rod 24 in the direction of the drive 2 always switches the switching device off. This is based on the assumption that the switching device was originally designed using the same drive 2 as that in the prior art, such that the drive 2 was connected at the same end of the first switching linkage 11 at which, in the described embodiments according to the invention, the transmission 15 is connected to the first switching linkage 11.

LIST OF REFERENCE SYMBOLS

1, 1', 1" Switch pole
2 Drive
3, 3', 3" Active part
4, 4', 4" Base flange
5, 4', 5" Isolator
6 Pole frame table
7 Pole frame
8, 8', 8" Rotatable shaft
9, 9', 9" Isolating intermediate piece
10, 10', 10" Lever system
11 First switching linkage
12 First lug
13, 13', 13" Rod element
14 First rocker lever
15 Transmission
15*a* Shaft
16 Internal tooth system
17 External tooth system
18 Rotation axis of the shaft
19 Bearing
20 Second rocker lever
21 Second switching linkage
22 Rod in the second switching linkage
23 Second lug
24 Drive rod
25, 25', 25" Holder
26, 26', 26" Curved lever
27, 27', 27" Angled lever
27*a*, 27*a'*, 27*a"* Second limb of the angled lever
28, 28', 28" Bolt
29 Parallelogram
A Longitudinal axis of the drive rod
F Foundation
G Straight line
G' Straight line
L Length of the first rocker lever
L' Length of the second rocker lever
P1 Position
P2 Position
P3 Position
P4 Position
S Longitudinal axis of the first switching linkage
α Angle
β Angle
β' Angle
θ Angle (between the projections of the lever arms of the rocker levers onto the first plane)

What is claimed is:

1. A switching device for switching high electrical currents and voltages, having at least one switch pole with a rotatable shaft operating the at least one switch pole, at least one lever system, a first switching linkage and at least one drive with a drive rod, with the rotatable shaft being connected to the at least one lever system, the at least one lever system being connected to the first switching linkage, and the first switching linkage being operatively connected to the drive rod such that a movement of the drive rod is converted to a rotary movement of the rotatable shaft, wherein a transmission, which is connected to the first switching linkage, and a second switching linkage, which is connected to the transmission and to the drive rod, are provided.

2. The switching device as claimed in claim 1, wherein the first switching linkage has an essentially straight section with a longitudinal axis, wherein an angle c between the longitudinal axis of the essentially straight section of the first switching linkage and a projection of a longitudinal axis of the drive rod onto a first plane can be chosen, wherein the first plane is defined in that it contains the longitudinal axis of the essentially straight section of the first switching linkage and is arranged perpendicular to the rotatable shaft.

3. The switching device as claimed in claim 2, wherein the angle a is chosen to be essentially 0°.

4. The switching device as claimed in claim 2, wherein the angle α is chosen to be essentially 90°, 180° or 270°.

5. The switching device as claimed in claim 1, wherein the first switching linkage has an essentially straight section with a longitudinal axis, and wherein the longitudinal axis lies in a first plane which is at right angles to the rotatable shaft, wherein a longitudinal axis of the drive rod lies in a second plane, which is different from the first plane but i parallel to the first plane.

6. The switching device as claimed in claim 1, wherein the transmission has a first rocker lever and a second rocker lever and a shaft, wherein the shaft is mounted in a rotatable fashion and a rotation axis of the shaft is aligned essentially parallel to the rotatable shaft wherein the two rocker levers are arranged essentially perpendicular to the rotating axis of the shaft, and wherein the first switching linkage is connected to the shaft in a movable fashion by means of the first rocker lever, and the second switching linkage is connected to the shaft in a movable fashion by means of the second rocker lever.

7. The switching device as claimed in claim 6, wherein the connection between the shaft and at least one of the rocker levers is in the form of an external tooth system with a matching internal tooth system.

8. The switching device as claimed in claim 6, wherein the at least one lever system has an angled lever with an apex and a first limb and a second limb, and wherein the angled lever is connected at its apex to the first switching linkage in a movable fashion, and wherein a bolt which is rigidly connected to the switch pole is connected to the second limb of the angled lever in a rotatable fashion, wherein a lever length of the first rocker lever and the arrangement of the shaft are chosen such that an intersection of the rotation axis of the shaft with the first plane, an intersection of the bolt with the first plane, a projection of the connection between the first rocker lever and the first switching linkage into the first plane, and a projection of the connection between the lever system and the first switching linkage into the first plane at least approximately form a parallelogram.

9. The switching device as claimed in claim 6, wherein the lever length of the first rocker lever is equal to the lever length of the second rocker lever.

10. The switching device as claimed in claim 1, wherein the switching device has a pole frame to which the at least one switch pole is connected, and wherein the pole frame has a pole frame table which is arranged essentially perpendicular to the rotatable shaft, wherein the drive is arranged essentially on a side of the pole frame table facing away from the at least one switch pole.

11. The switching device as claimed in claim 1, wherein the switching device has three switch poles.

12. The switching device as claimed in claim 11, wherein a first lever system is provided for a first switch pole, a second lever system is provided for a second switch pole, and a third lever system is provided for a third switch pole, wherein the transmission is connected to the first switching linkage such that a movement of the first switching linkage at the same time produces either a pushing force on the first lever system, the second lever system and the third lever system or at the same time produces pulling force on the first lever system, the second lever system and the third lever system.

13. The switching device as claimed in claim 11, wherein a first lever system is provided for a first switch pole, a second lever system is provided for a second switch pole, and a third lever system is provided for a third switch pole, wherein the following connections to the,e first switching linkage are arranged in the sequence stated here:

connection of the transmission to the first switching linkage, connection of the first lever system to the first switching linkage, connection of the second lever system to the first switching linkage, and connection of the third lever system to the first switching linkage.

14. The switching device as claimed in claim 12, wherein the switching device is a generator switch, and wherein the drive is in the form of a hydraulic spring storage drive.

15. The switching device of claim 1, wherein the transmission is separate from the drive.

16. The switching device of claim 1, wherein the second switching linkage is connected between the transmission and the drive rod.

* * * * *

UNITED STATES PATENT AND TRADEMARK OFFICE

CERTIFICATE OF CORRECTION

PATENT NO. : 6,943,307 B2
APPLICATION NO. : 10/485866
DATED : September 13, 2005
INVENTOR(S) : Olaf Hunger et al.

It is certified that error appears in the above-identified patent and that said Letters Patent is hereby corrected as shown below:

Title Page, Item (73) Assignee: Change "Alstom Technology Ltd" to -- ABB Schweiz AG --

Signed and Sealed this

Twenty-second Day of May, 2007

JON W. DUDAS
*Director of the United States Patent and Trademark Office*